US009604826B2

(12) United States Patent
Fretz

(10) Patent No.: US 9,604,826 B2
(45) Date of Patent: Mar. 28, 2017

(54) LOW PROFILE ROLLER FAIRLEAD

(71) Applicant: Warn Industries, Inc., Clackamas, OR (US)

(72) Inventor: Darren G. Fretz, Canby, OR (US)

(73) Assignee: Warn Industries, Inc., Clackamas, OR (US)

( * ) Notice: Subject to any disclaimer, the term of this patent is extended or adjusted under 35 U.S.C. 154(b) by 598 days.

(21) Appl. No.: 13/757,360

(22) Filed: Feb. 1, 2013

(65) Prior Publication Data

US 2014/0001428 A1 Jan. 2, 2014

Related U.S. Application Data

(60) Provisional application No. 61/665,952, filed on Jun. 29, 2012.

(51) Int. Cl.

| | |
|---|---|
| ***B66D 1/36*** | (2006.01) |
| ***B66D 1/02*** | (2006.01) |
| ***B66D 1/12*** | (2006.01) |
| ***B66D 1/14*** | (2006.01) |

(52) U.S. Cl.

CPC ..... *B66D 1/36* (2013.01); *B66D 1/02* (2013.01); *B66D 1/12* (2013.01); *B66D 1/14* (2013.01)

(58) Field of Classification Search

CPC . B66D 1/36; B66D 1/365; B66D 1/38; B66D 1/39; B66D 2700/0191; B66D 1/02; B66D 1/12; B66D 1/14; B60P 3/41; B60P 3/1066

USPC ..... 254/323, 325–327, 334, 338

See application file for complete search history.

(56) References Cited

U.S. PATENT DOCUMENTS

| | | | | |
|---|---|---|---|---|
| 298,241 | A * | 5/1884 | Schneider | 254/395 |
| 1,325,616 | A | 9/1885 | Lyons | |
| 2,551,141 | A | 12/1895 | McNutt | |
| 1,589,776 | A * | 6/1926 | Warden | 254/395 |
| 2,422,353 | A * | 6/1947 | Hitt | 242/157 R |
| 3,048,369 | A | 8/1962 | Hanson | |
| 3,070,355 | A | 12/1962 | Wyatt | |
| 3,072,384 | A | 1/1963 | Apichell | |
| 3,645,503 | A | 2/1972 | Doerfling | |
| 3,764,020 | A | 10/1973 | Batson | |
| 4,123,040 | A | 10/1978 | Kuzarov | |
| 4,552,340 | A | 11/1985 | Sheppard | |
| 4,846,090 | A | 7/1989 | Palmquist | |

(Continued)

OTHER PUBLICATIONS

ISA United States Patent and Trademark Office, International Search Report and Written Opinion of PCT/US2014/11199, WIPO, May 7, 2014, 15 pages.

*Primary Examiner* — Sang Kim
*Assistant Examiner* — Nathaniel Adams
(74) *Attorney, Agent, or Firm* — McCoy Russell LLP

(57) ABSTRACT

A fairlead assembly includes a frame structure having an opening therein. A pair of rollers are disposed on opposite sides of the opening. The frame structure includes a pair of opposed curved surfaces disposed between the end portions of the pair of rollers and defining a bordering surface of the opening. The frame can be cast as a unitary structure with the pair of rollers each rotatably supported by a support pin having opposite ends received in a first set of corresponding semi-cylindrical recesses in a surface of the cast frame. A clamp structure having a second set of corresponding semi-cylindrical recesses secure the support pins to the cast frame.

16 Claims, 4 Drawing Sheets

(56) References Cited

U.S. PATENT DOCUMENTS

| | | | | |
|---|---|---|---|---|
| 5,495,995 | A | 3/1996 | Dominique et al. | |
| 5,634,628 | A | 6/1997 | Schuch | |
| 6,631,886 | B1 * | 10/2003 | Caudle et al. | 254/327 |
| D640,442 | S | 6/2011 | Borntrager et al. | |
| 2009/0146119 | A1 | 6/2009 | Bailey et al. | |
| 2011/0168961 | A1 | 7/2011 | Christiansen | |

* cited by examiner

LOW PROFILE ROLLER FAIRLEAD

CROSS-REFERENCE TO RELATED APPLICATIONS

This application claims the benefit of U.S. Provisional Application No. 61/665,952, filed on Jun. 29, 2012. The entire disclosure of the above application is incorporated herein by reference.

FIELD

The present disclosure relates to cable pulling devices such as a winch or hoist and more particularly to a low profile roller fairlead for a cable pulling device.

BACKGROUND

This section provides background information related to the present disclosure which is not necessarily prior art.

Fairleads are commonly used for guiding a cable or rope from a winch, hoist, or other pulling tool. Known fairleads include an opening through which the cable or rope is guided between a first opposing pair of rollers that are disposed above and below the opening, as well as a second opposing pair of rollers on each side of the opening for providing a rolling surface along which the cable can be pulled with little frictional resistance. Because of the stacking arrangement of the rollers, the fairlead assembly can have a fairly tall profile. Accordingly, it is desirable to provide a lower profile fairlead that still maintains reduced friction on the cable or rope that is led therethrough.

SUMMARY

This section provides a general summary of the disclosure, and is not a comprehensive disclosure of its full scope or all of its features.

A fairlead assembly includes a frame structure having an opening therein. A pair of horizontal rollers are disposed on opposite upper and lower sides of the opening. The frame structure includes a pair of opposed curved side surfaces disposed between and enveloping the end portions of the pair of rollers and defining a side bordering surface of the opening.

The frame can be cast as a unitary structure with the pair of rollers each rotatably supported by a support pin having opposite ends received in a first set of corresponding semi-cylindrical recesses in a surface of the cast frame. A clamp structure having a second set of corresponding semi-cylindrical recesses secure the support pins to the cast frame. The fairlead assembly has a low profile while using upper and lower horizontal rollers and curved side walls generally in a same plane as the horizontal rollers for guiding the winch cable.

According to a further alternative aspect of the present disclosure, the pair of rollers can include a support pin having opposite ends each received in an aperture within the frame. One or both ends of the support pins can include a recessed groove for receiving a C-clamp to secure the support pins to the frame.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
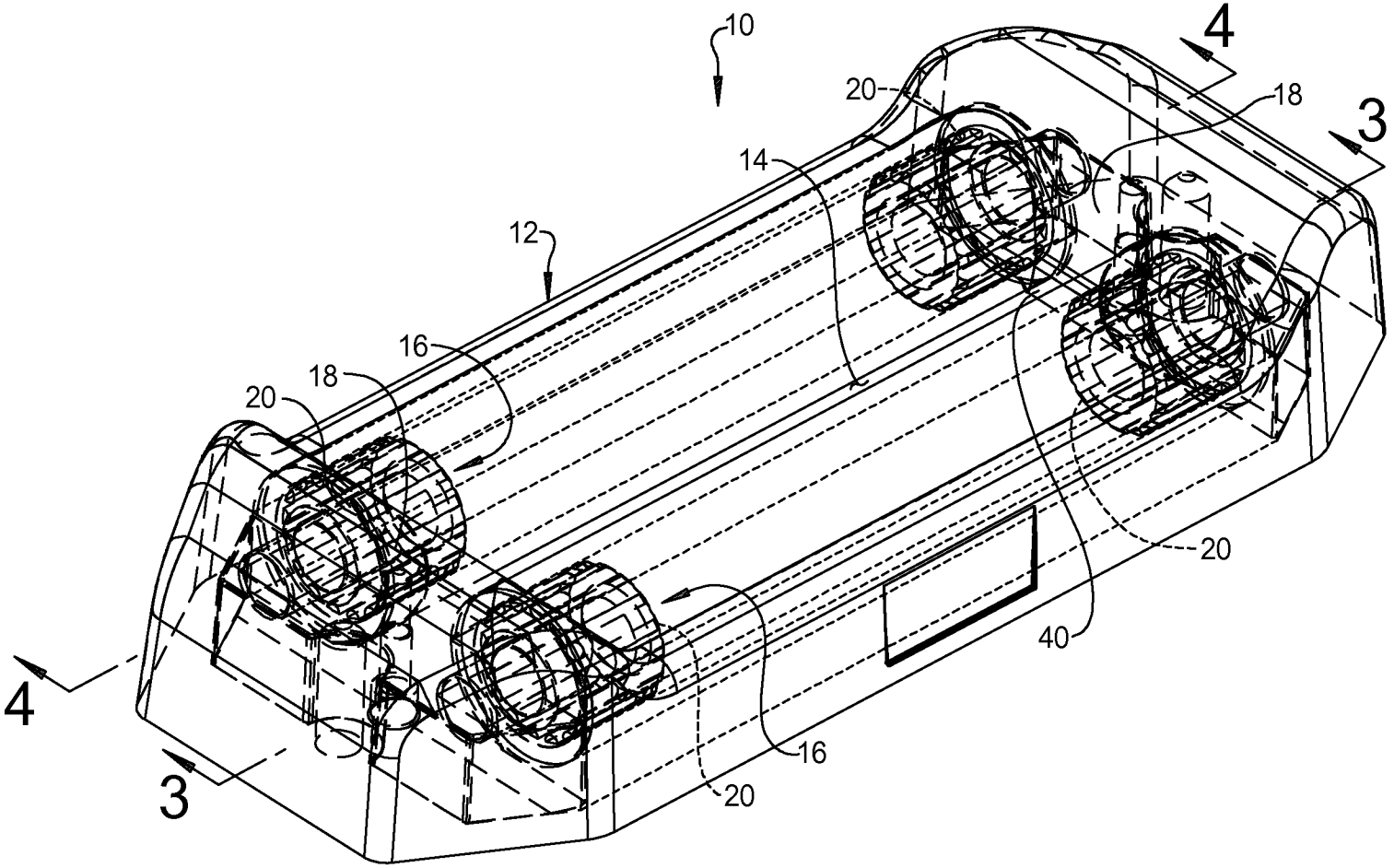
FIG. 1 is perspective view of a low profile roller fairlead according to the principles of the present disclosure.
Figure 2:
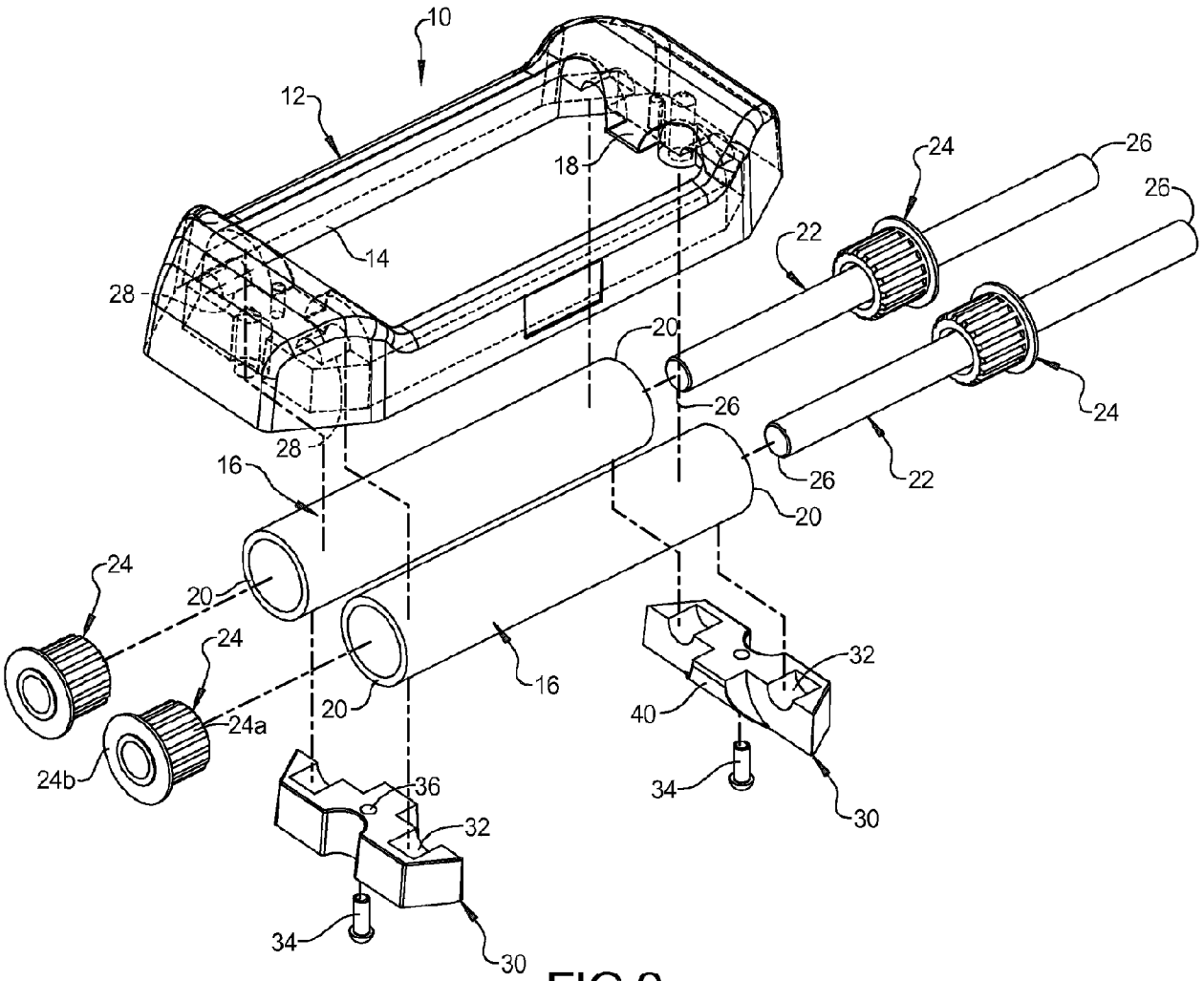
FIG. 2 is an exploded perspective view of the components of the roller fairlead assembly shown in FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, the fairlead assembly 10, according to the principles of the present disclosure, will now be described. The fairlead assembly 10 includes a frame 12 defining an opening 14 therethrough and supporting a pair of rollers 16 on opposite sides of the opening 14. The frame 12 can be formed by a casting process to form a unitary structure. The frame 12 can include a pair of opposed curved surfaces 18 disposed between the end portions 20 of the pair of rollers 16 in a close proximity thereto for defining a bordering surface of the opening 14. The pair of opposed curved surfaces 18 can overlap the end portions 20 of the pair of rollers 16.

The pair of rollers 16 are each rotatably mounted on a respective support pin 22 by a pair of journals 24 disposed on each end of the support pins 22. The journals 24 can be rotatably mounted on the support pins 22 and can be press fit into the ends of the rollers 16. The journals 24 can be provided with a serrated outer surface 24*a* and an end flange 24*b* that serves as a stop as the journal 24 is press fit into the end of the roller 16.

The ends 26 of the support pins 22 can each be received in a semi-cylindrical recess 28 that is formed into the cast frame 12 at each end. A pair of clamp members 30 are each provided with corresponding semi-cylindrical recesses 32 for securing the support pins 22 to the frame 12. The clamp members 30 are secured to the frame 12 by threaded fasteners 34 which are received in apertures 36 provided in the clamp member 30 and threaded apertures 38 provided in the frame member 12. The clamp members 30 are each provided with a curved surface 40 that is coincident with the opposed curved surfaces 18 of the frame 12 to provide a continuous curved surface from the inside around to the outside of the frame 12.

Figure 3:
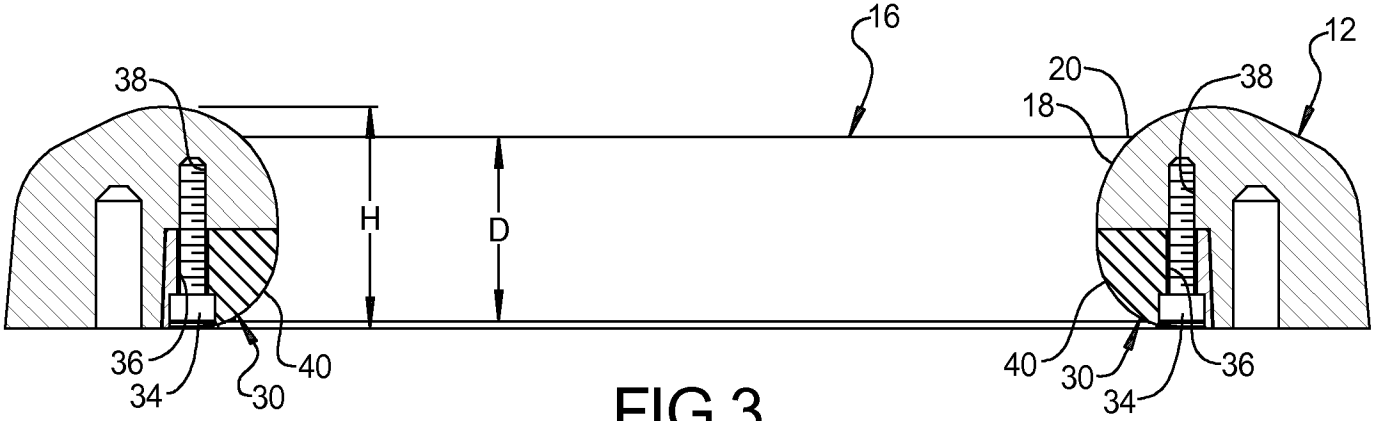
FIG. 3 is a cross-sectional view of the roller fairlead taken along line 3-3 of FIG. 1.
Figure 4:
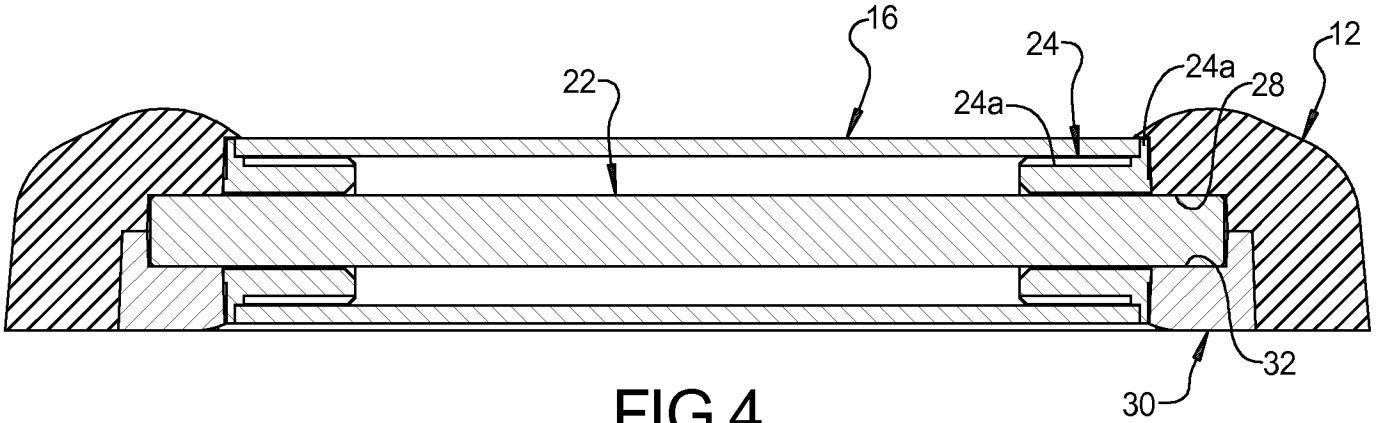
FIG. 4 is a cross-sectional view of the roller fairlead taken along line 4-4 of FIG. 1.

As best illustrated in FIG. 3, the pair of opposed curved surfaces 18 overlap the end portion 20 of the pair of rollers 16 so that the sharp edges on the ends of the rollers 16 are not exposed to the cable or rope that is guided therethrough. Furthermore, the pair of curved surfaces closely envelop the ends 20 of the rollers 16 to provide a very small gap therebetween so that a cable or rope cannot become bound in the gap.

As illustrated in FIG. 3, the fairlead has an uppermost surface and a lowermost surface that define a height profile of the fairlead assembly wherein the height profile is only slightly larger than the diameter D of the rollers 16. According to a preferred embodiment, the height profile H is less than two times the diameter D of the roller 16. According to a more preferred embodiment, the height profile H is less than 1.5 times, and more preferably, less than 1.33 times the diameter D of the rollers 16. In the embodiment shown, the height H is less than 1.25× the diameter D of the rollers 16.

It is noted that the frame 12 can be cast from iron, aluminum, or other metals, or from plastic or composite materials. The clamp members 30 can also be made of the same materials or different materials than the frame 12.

Figure 5:
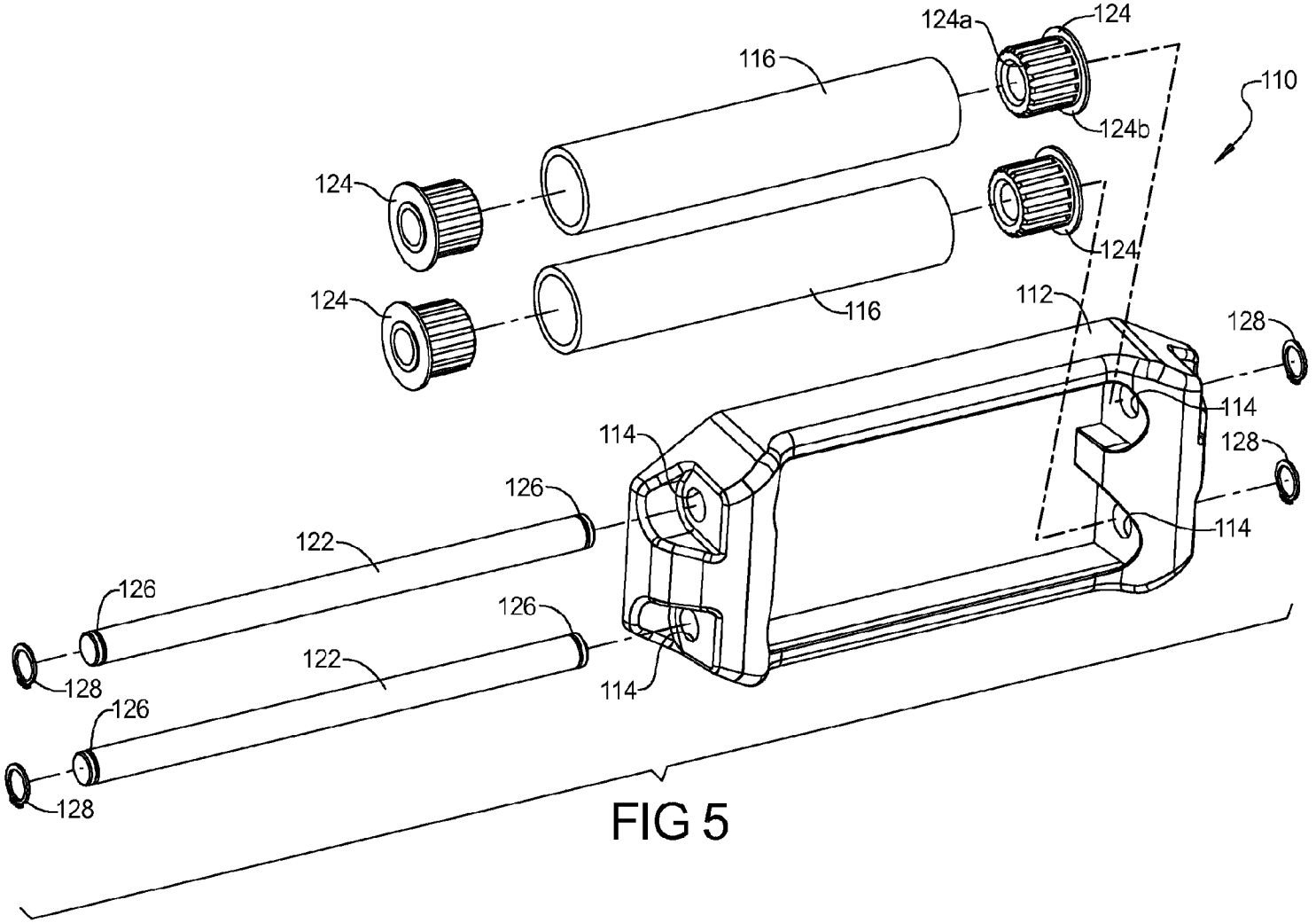
FIG. 5 is an exploded perspective view of an alternative roller fairlead assembly according to the principles of the present disclosure.

According to an alternative embodiment as illustrated in FIG. 5, the frame 112 can be provided with a pair of apertures 114 at opposite ends. A pair of rollers 116 are each rotatably mounted on a respective support pin 122 by a pair of journals 124 disposed on each end of the support pins 122. The journals 124 can be rotatably mounted on the support pins 122 and can be press fit into the ends of the rollers 116. The journals 124 can be provided with a serrated outer surface 124*a* and an end flange 124*b* that serves as a stop as the journal 124 is press fit into the end of the rollers 116. One or both ends of the support pins 122 can be provided with a recessed groove 126 for receiving a C-clamp 128 to secure the support pins to the frame 112. As an alternative, it should be understood that the support pins 122 can also be provided with an end flange on one end that is integrally formed with the support pin so that only one C-clamp 128 is needed at one end of the support pin 122. It is noted that with this embodiment, the function of the fairlead 110 is very similar to the function of the fairlead 10 as described above.

With the low profile roller fairlead 10, 110 according to the principles of the present disclosure, the fairlead is made with a robust construction having a very low height profile and with no sharp edges that can fray a cable or rope that is directed therethrough.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fairlead assembly, comprising:

a frame structure having an opening therein; and a pair of rollers disposed on opposite sides of said opening, said rollers each having two end portions, said frame structure having a pair of opposed curved surfaces including a first curved surface disposed between, in a direction perpendicular to an axis of rotation of each roller of the pair of rollers, first end portions of outer surfaces of said pair of rollers and a second curved surface disposed between, in the direction perpendicular to the axis of rotation of each roller of the pair of rollers, second end portions of outer surfaces of said pair of rollers and defining a bordering surface of said opening;

wherein said pair of opposed curved surfaces overlap said end portions of said pair of rollers, around the outer surfaces of the pair of rollers in a direction of the axis of rotation of each roller, wherein a line normal to the outer surfaces is perpendicular to the axis of rotation, and wherein the pair of opposed curved surfaces extend inward into an interior of the frame structure from the end portions of the pair of the rollers, a width and height of the opposed curved surfaces decreasing as the pair of opposed curved surfaces extend inward into the interior of the frame structure.

2. The fairlead assembly according to claim 1, wherein said pair of rollers are each rotatably mounted on a respective support pin supported by said frame structure, wherein the width and height of the pair of opposed curved surfaces are each defined perpendicular to the axis of rotation, and wherein an outer edge of the pair of opposed curved surfaces is flush with an outer, forward-facing surface of the frame structure and wherein an inner edge of the pair of opposed curved surfaces is narrower than the outer edge and positioned inward in the frame structure relative to the outer, forward-facing surface and the end portions of the pair of rollers.

3. The fairlead assembly according to claim 2, wherein said frame structure includes a pair of recesses receiving opposite ends of each of said respective support pins.

4. The fairlead assembly according to claim 3, further comprising a clamp structure secured to said frame structure to engage said support pins to said frame structure.

5. The fairlead assembly according to claim 4, wherein said clamp structure includes a pair of curved surfaces that are coincident with said pair of opposed curved surfaces of said frame structure.

6. The fairlead assembly according to claim 2, further comprising a journal disposed between each end of said pair of rollers and said support pins and wherein the first curved surface extends between the first end portions of the outer surfaces of the pair of rollers and the second curved surface extends between the second end portions of the outer surfaces of the pair of rollers.

7. The fairlead assembly according to claim 1, wherein an axis of rotation of a first roller of the pair of rollers and an axis of rotation of a second roller of the pair of rollers lie in a common plane and said frame structure has a lower-most surface spaced from said common plane in a first direction and an upper-most surface spaced from said common plane in a second direction opposite to said first direction, wherein a distance between said upper-most surface and said lower-most surface defines a height profile of said fairlead assembly, wherein said height profile of said fairlead assembly is less than 1.5 times a diameter of one of said pair of rollers.

8. The fairlead assembly according to claim 2, wherein said frame structure has a pair of apertures receiving opposite ends of each of said respective support pins.

9. The fairlead assembly according to claim 5, wherein said support pins each include at least one recessed groove for receiving a C-clamp for securing the support pins to the frame.

10. The fairlead assembly according to claim 1, wherein said pair of rollers' axes are parallel.

11. The fairlead assembly according to claim 1, wherein said pair of rollers comprises a length greater than a distance between said pair of rollers.

12. A fairlead assembly, comprising:

a cast frame formed as a unitary structure having an opening therein;

a pair of rollers disposed on opposite sides of said opening, said rollers each rotatably supported by a support pin having opposite ends received in a first set of corresponding semi-cylindrical recesses in a surface of said cast frame;

a clamp structure having a second set of corresponding semi-cylindrical recesses opposing said first set of corresponding semi-cylindrical recesses and securing said support pin to said cast frame;

wherein said pair of rollers each have an axis of rotation that lie in a common plane; and a pair of opposed curved surfaces overlapping said ends of said pair of rollers, around outer surfaces of the pair of rollers in a direction of the axis of rotation of each roller, wherein a line normal to the outer surfaces is perpendicular to the axis of rotation, wherein the pair of opposed curved surfaces extend inward into an interior of the frame from end portions of the pair of the rollers, a width and height of the opposed curved surfaces decreasing as the pair of opposed curved surfaces extend inward into the interior of the frame, wherein the width and height of the pair of opposed curved surfaces are each defined perpendicular to the axis of rotation, wherein an outer edge of the pair of opposed curved surfaces is flush with an outer, forward-facing surface of the frame and wherein an inner edge of the pair of opposed curved surfaces is narrower than the outer edge and positioned inward in the frame relative to the outer, forward-facing surface and the end portions of the pair of rollers, each curved surface disposed between end portions of the outer surfaces of said pair of rollers wherein a first curved surface of the pair of opposed curved surfaces is positioned between, in a direction perpendicular to the axis of rotation, a first end of a first roller of said pair of rollers and a first end of a second roller of said pair of rollers, and wherein a second curved surface of the pair of opposed curved surfaces is positioned between, in the direction perpendicular to the axis of rotation, a second end, opposite the first end, of the first roller and a second end, opposite the first end, of the second roller.

13. The fairlead assembly according to claim 12, wherein said pair of opposed curved surfaces defines a bordering surface of said opening.

14. The fairlead assembly according to claim 12, further comprising a journal disposed between each end of said pair of rollers and said support pins, wherein said pair of rollers' axes are parallel.

15. The fairlead assembly according to claim 12, wherein said cast frame has a lower-most surface spaced from said common plane in a first direction and an upper-most surface spaced from said common plane in a second direction opposite to said first direction, wherein a distance between said upper-most surface and said lower-most surface defines a height profile of said fairlead assembly, wherein said height profile of said fairlead assembly is less than 1.5 times a diameter of one of said pair of rollers.

16. A fairlead assembly, comprising:

a cast frame formed as a unitary structure having an opening therein;

a single pair of rollers disposed on opposite sides of said opening, said rollers each rotatably supported by a support pin having opposite ends received in a first set of corresponding semi-cylindrical recesses in a surface of said cast frame;

a clamp structure having a second set of corresponding semi-cylindrical recesses opposing said first set of corresponding semi-cylindrical recesses and securing said support pin to said cast frame;

wherein each of said pair of rollers has a parallel axis of rotation that lies in a common plane; and a pair of opposed curved surfaces overlapping said ends of said pair of rollers, around outer surfaces of the pair of rollers in a direction of the axis of rotation of each roller, wherein a line normal to the outer exposed surfaces is perpendicular to the axis of rotation, wherein the pair of opposed curved surfaces extend inward into an interior of the frame from end portions of the pair of the rollers, a width and height of the opposed curved surfaces decreasing as the pair of opposed curved surfaces extend inward into the interior of the frame, wherein the width and height of the pair of opposed curved surfaces are each defined perpendicular to the axis of rotation, wherein an outer edge of the pair of opposed curved surfaces is flush with an outer, forward-facing surface of the frame, wherein an inner edge of the pair of opposed curved surfaces is narrower than the outer edge and positioned inward in the frame relative to the outer, forward-facing surface and the end portions of the pair of rollers, and wherein a first curved surface of the pair of opposed curved surfaces is positioned between, in a direction perpendicular to the axis of rotation, a first end of a first outer surface of a first roller of said pair of rollers and a first end of a second outer surface of a second roller of said pair of rollers, and wherein a second curved surface of the pair of opposed curved surfaces is positioned between, in the direction perpendicular to the axis of rotation, a second end, opposite the first end, of the first outer surface of the first roller and a second end, opposite the first end, of the second outer surface of the second roller.

* * * * *